United States Patent [19]

Simeth

[11] Patent Number: 4,824,094

[45] Date of Patent: Apr. 25, 1989

[54] DEVICE FOR ENGAGING A SHEET WITH MAINTENANCE OF REGISTER AND DISPOSED IN THE FEEDER PLATE OF A ROTARY PRESS

[76] Inventor: Claus Simeth, Geschwister-Scholl-Str. 15-17, 6050 Offenbach/Main, Fed. Rep. of Germany

[21] Appl. No.: 90,462

[22] Filed: Aug. 27, 1987

[30] Foreign Application Priority Data

Aug. 27, 1986 [DE] Fed. Rep. of Germany ..... 3629080

[51] Int. Cl.[4] ..... B65H 9/14

[52] U.S. Cl. ..... 271/231; 271/237; 271/276; 271/208

[58] Field of Search ..... 271/276, 229, 231, 237, 271/245

[56] References Cited

U.S. PATENT DOCUMENTS 2,160,906 6/1939 Reinartz ..... 271/231

3,190,644 6/1965 Schwebel ..... 271/231

*Primary Examiner*—Richard A. Schacher

[57] ABSTRACT

A suction roll sheet transfer device disposed between a sheet feed table and the front lays of a sheet fed rotary printing press including a first set of suction rolls adapted for oscillating movement between a position substantially in the plane of said feed table for engaging successive sheets under suction pressure and transferring the sheet in register toward the front lays of the press and a raised position for engaging a preceeding sheet and separating it from the following sheet disposed therebelow, even when the sheets are in strongly adhering relation to each other during high speed printing operations. Suction pressure is communicated to the suction rolls in predetermined timed intervals, commencing upon retraction of the suction rolls substantially to the plane of the feed table. In a second embodiment, non-displaceable suction rolls are disposed immediately below the plane of the feeder plate upstream of the oscillating suction rolls for engaging successive sheets, under the influence of suction pressure, and guiding the sheets onto the oscillating suction rolls. In that embodiment, deionizers with air nozzles are disposed between the oscillating suction rolls and the non-displaceable suction rolls for directing a timed, pressurized air flow against successive sheets to facilitate separation of the partially overlapping sheets.

15 Claims, 2 Drawing Sheets

DEVICE FOR ENGAGING A SHEET WITH MAINTENANCE OF REGISTER AND DISPOSED IN THE FEEDER PLATE OF A ROTARY PRESS

DESCRIPTION OF THE INVENTION

The present invention relates to devices for engaging and maintaining the register of sheets during their transfer from a feed table to the front lays of a sheet fed rotary printing press.

It is known to utilize suction rolls in a recess of a feeder plate near the front lays of a sheet fed rotary printing press so that successive sheets of a staggered flow of sheets being conveyed to the printing press are engaged by suction, slowed down, and drawn downwardly into proper alignment and register for feeding to the press. In high speed printing operations, however, the successive sheets tend to strongly adhere together, which can impede the effectiveness of the suction rolls in maintaining proper register of the sheets.

It is an object of the present invention to provide a suction roll device which more reliably enables sheets to be supplied from a feed table to the front lays of a sheet fed rotary printing press in proper registration even when the press is operated at high speeds.

Another object is to provide a suction roll device as characterized above that is adapted to separate strongly adhering successive sheets that are disposed one on the other, and thereby more reliably insure that the front edges of successive sheets are accurately fed onto the front lays of the press.

Other objects and advantages of the invention will become apparent upon reading the following detailed description and upon reference to the drawings, in which.

Figure 1:
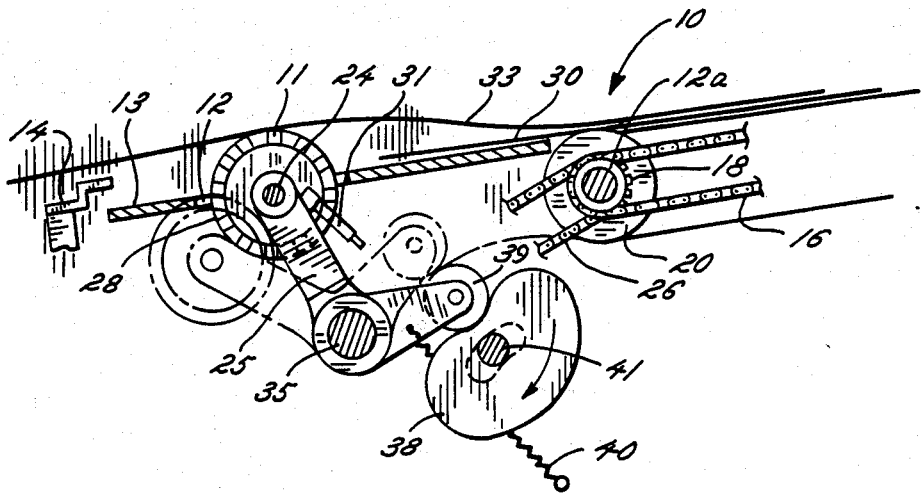
FIG. 1 is a partially diagrammatic, longitudinal section of an illustrative sheet feeding apparatus embodying the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

Figure 2:
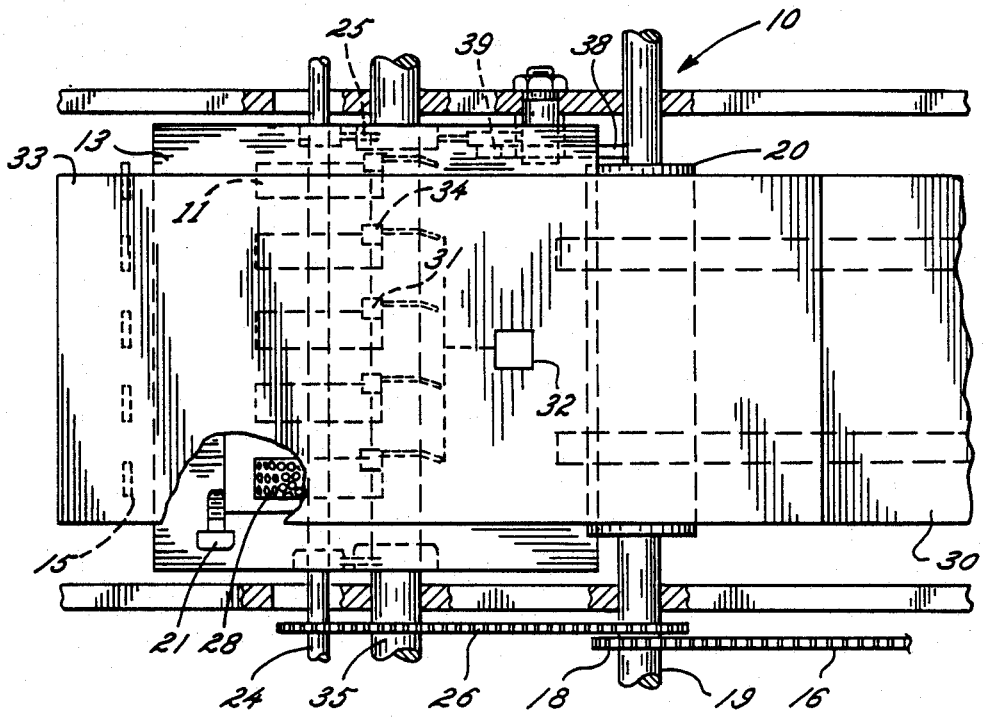
FIG. 2 is a plan view of the apparatus shown in FIG. 1.

Referring now more particularly to FIGS. 1 and 2 of the drawings, there is shown an illustrative sheet feeding apparatus 10 embodying the present invention, which includes suction rolls 11 that are disposed in recesses 12 in a feeder plate 13 disposed between a feed table 15 and the front lays 14 of a typical sheet fed rotary printing press. The feed table 15 may be of a conventional type, comprising a plurality of belts driven by a chain or belt 16, or similar transmission, which drives a sprocket 18 on a shaft 19 for one of the belt rolls 20. The sheets are successively fed from the feed table 15 in a conventional manner onto the feeder plate 13 for action upon by the suction rolls 11. The front lays 14 may be provided with an appropriate covering in a conventional manner, and side lays 21, which may be of a known pneumatic type, preferably are located upstream of the front lays.

In accordance with the invention, the suction rolls are adapted to engage successive sheets delivered from the feed table in order to maintain proper register of each sheet as it is delivered onto the front lays of the printing press and to also reliably separate successive sheets from each other, even when in strongly adhering relation to each other during high speed printing operations. The suction rolls 11, in this case, comprise a plurality of axially spaced rolls mounted on a common shaft 24 that is in turn supported at opposed ends by double armed levers 25. The rolls 11 may be rotatably driven at press speed by a drive train 26, which in this case is operatively connected to the feed table drive. Since the rolls 11 are rotably driven at press speed, no detramental friction occurs between the rolls and each sheet as the sheet is being supplied in registration from the feed table to the front lays of the press. As is known in the art, the transmission to the suction rolls 11 can be adapted to compensate for belt slippage or drive losses in the feed table. The sheets can be supplied at a rate of conveyance compatible with paper quality and sheet size and with predetermined intervals between sheets, and known means can be provided for decelerating, or stopping sheets at determined intervals, to ensure that the sheets are reliably aligned with the front and side lays of the press.

The rolls 11 are formed with suction nozzles or bores 28 on their periphery, adapted for entraining successive sheets 30 being introduced onto the feeder plate 13 from the feed table 15. For permitting predetermined timing of the suction pressure to the rolls 11, suction air to the rolls 11 may be controlled in a known manner, such as by valves 31 disposed between an appropriate suction air source 32 and air chambers 34 disposed in the rolls in a known manner. Alternatively, suction air timing could be effected by means of a rotary valve having an external bore for communicating suction pressure to pneumatic side lays of the press.

In keeping with the invention, the suction roll support levers 25 are pivotable about a support shaft 35 for selectively moving the suction rolls 11 in timed relation to communication of suction pressure to the rolls between a retracted position, as shown in phantom in FIG. 1, during which time the suction rolls engage, through suction pressure, the underside of successive lower sheets 30 being discharged from the feed table 15, and a raised position, as shown in solid lines in FIG. 1, during which time the rolls act to separate the lower sheet 30 from an upper preceeding sheet 33 being introduced into the front lays 14 of the press. For oscillating the suction rolls 11 between such raised and retracted positions, an eccentrically mounted cam 38 is adapted to act upon a roller 39 mounted on a second arm of one of the double armed lever 25 for pivoting the levers 25 about their pivot shaft 35. The double arm lever 25 is biased toward the suction roll raised position by a return spring 40 coupled between the frame of the press and the lever 25. The stroke and duration of the pivoting movement of the double arm lever 25, and the suction rolls 11 carried thereon, may be controlled by the shape of the cam 38, as well as by appropriate adjustment of the eccentric mounting of the cam 38 on its drive shaft 41, thereby permitting adaptation to different sheet formats and papers qualities. A defined pivoting movement can thereby be established for suction rolls 11 as they are oscillated between their raised and retracted positions.

Oscillating movement of the suction rolls 11 preferably is controlled such that the departing sheet 33 is separated from the lower sheet 30 by initial raising movement of the suction rolls 11 and is retained above the plane of the feeder plate 13 for sufficient time to permit reliable entry of the departing sheet 33 into the front lays 14. Upon decent of the rolls 11, suction pressure may be communicated to the rolls so that they engage the lower sheet 30 and tighten the sheet as it is directed forwardly under the influence of the suction rolls. The departing or top sheet 33 re-engages with the sheet 30 below it as the latter sheet 30 abuts the front lays 14, with the sheet 33 moving smoothly over the sheet 30.

As the suction rolls decend from their top or reversible position, the next sheet 30 generally will engage the rolls 11 and mask the nozzles 28 thereof to some extent. As the nozzles 28 of the rolls 11 decend to the plane of the feed table 13, suction pressure preferably is communicated to the rolls such that the bottom sheet is pulled below the front lays 14 prior to entry thereto. The suction pressure to the rolls 11 may be timed to operate for a predetermined periods, so that once the sheet 30 is pulled below the front lays 14, the suction pressure can be significantly reduced or terminated. Such operation is advantageous in that upon reduction or termination of the suction pressure, the frictional contact of the sheet on the feed table is not so great as to prevent lateral alignment of the sheet at the side lays 21. The foregoing operation, therefore, has been found to permit reliable separation of overlapping sheets 30, 33 even when in tightly adhering relation to each other during high speed operation of the press, while ensuring that the sheets are supplied in registration to the press.

Figure 3:
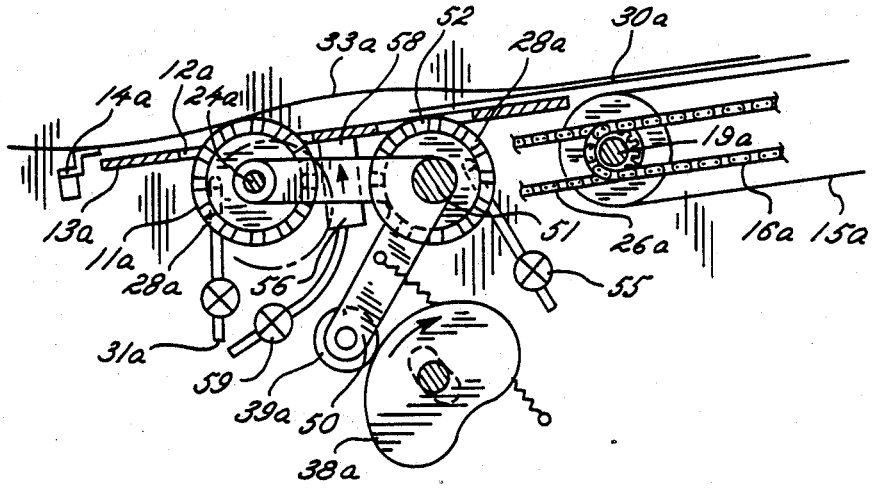
FIG. 3 is a longitudinal section of an alternative embodiment of sheet feeding apparatus according to the invention.

Referring now to FIG. 3, there is shown an alternative embodiment of the invention, wherein items similar to those described above have been given similar reference numerals with the distinquishing "a". The sheet feeding apparatus 10*a* again comprises oscillating suction rolls 11*a* disposed between a sheet feed table 15*a* and front lays 14*a* of the rotary sheet fed printing press. For selectively oscillating the suction rolls 11*a* in this case, the suction rolls are mounted on double armed levers 50, which in turn are pivotably mounted on a shaft 51 and for oscillating movement controlled by an accentrically mounted cam 38*a*, in a manner similar to that previously described.

In keeping with an important aspect of this embodiment of the invention, non-displacable suction rolls 52 are disposed immediately below the plane of the feed table 13*a* upstream of the oscillating suction rolls 11*a*. The non-displaceable suction rolls 52 in this instance are mounted on the shaft 51 for the double arm levers 50 and are driven by a drive train 26*a* operatively coupled to the drive shaft 19*a* for the feed table 15*a*.

Suction air may be communicated to the non-displaceable suction rolls 52 through an appropriate control valve 55, such that a suction pressure is applied to the sheet 30*a* as it proceeds over the feed plate 13*a* prior to reaching the displaceable suction rolls 11*a*. A deionizer 18 of a conventional type preferably is provided between the displaceable suction rolls 11*a* and the non-displaceable suction rolls 52 and is adapted for providing a continuous discharge. In addition, a pressurized air stream may be discharged from air blowing nozzles 58 of the deionizer 56 in timed fashion between the departing top sheet 33*a* and the next sheet 30*a* below. The air stream may be directed at an angle such that it lifts the departing sheet 33 prematurely, but without the known Bernoulli effect occurring between the two sheets 30*a*, 33*a*. Shortly before the sheet 30*a* covers the air blowing nozzles 58 of the deionizer 56, a valve 59 may be operated to terminate the air discharge.

In the event that electrostatic charges between the sheets are so great that the lower sheet 30*a* re-engages a departing upper sheet 33*a* after passing the nondisplaceable rolls 52, the oscillating rolls 11*a* will act on the sheets in the manner previously described to ensure reliable separation of the sheets 30*a* and 33*a* and will draw the sheet 30*a* down so as to permit reliable introduction of the sheet 30*a* into the front lays of the printing press.

From the foregoing, it will be seen that the sheet feeding apparatus of the present invention is adapted for permitting more reliable supply of sheets from the feed table to the front lays of a sheet fed rotary printing press in proper registration even when sheets are in strongly adhering relation to each other.

I claim as my invention:

1. An apparatus disposed between the front lays of a sheet fed rotary printing press and a sheet feed table adapted for supplying a flow of partially overlapping sheets comprising: suction rolls disposed below the path of said flow of sheets, means supporting said suction rolls for rotational movement, means for rotatably driving said suction rolls, means for supplying a timed supply of suction pressure to said suction rolls to create a suction pressure at the periphery of said rolls for enabling said suction rolls to engage the underside of successive sheets under the influence of said suction pressure and transfer the engaged sheet in proper register in the direction of said first lays, said suctions rolls being mounted for oscillating movement between a retracted position in which the upper periphery of said rolls is substantially in the plane of said feed table and a raised position in which the upper periphery of said rolls is above the level of said feeder plate, and means for oscillating said suction rolls between said retracted and raised positions such that said suction rolls physically engage the underside of successive sheets directed from said feed table for raising the engaged sheet and separating it from a flowing sheet disposed below the engaged sheet.

2. The apparatus of claim 1 in which said suction pressure supply means supplies suction pressure to said suction rolls in predetermined intervals commencing upon said suction rolls being moved to said retracted position for causing said suction rolls to engage the underside of said next following sheet under the influence of suction pressure while in said retracted position.

3. The apparatus of claim 1 in which said suction roll supporting means includes a pair of pivotably mounted levers, and said oscillating means includes means for oscillating said levers.

4. The apparatus of claim 1 including non-displaceable suction rolls disposed immediately upstream of said oscillating rolls, said non-displaceable suction rolls being rotably driven, and means for communicating suction pressure to said non-displaceable suction rolls whereby said non-displaceable suction rolls engage the underside of successive sheets under the influence of suction pressure and guide said engaged sheets in proper registration onto said oscillating suction rolls.

5. The apparatus of claim 4 including a deionizer disposed between said oscillating suction rolls and said non-displaceable suction rolls, said deionizer being operative for discharging an air flow in timed relation to the flow of said sheets for separating each sheet from the next following sheet.

6. A sheet transfer apparatus disposed between the front lays of a sheet fed rotary printing press and a sheet feed table adapted for supplying a flow of partially overlapping sheets comprising: a feeder plate across which a flow of said sheets is directed from said feed table, suction rolls disposed in said feeder plate below the path of said flow of sheets, means supporting said suction rolls for rotational movement, means for rotatably driving said suction rolls, means for supplying a timed supply of suction pressure to said suction rolls for creating a suction pressure at the periphery of said rolls, said suction rolls being mounted for oscillating movement between a retracted position in which the upper periphery of said rolls is substantially in the plane of said feeder plate and a raised position in which the upper periphery of said rolls is above the level of said feeder plate, and means for oscillating said suction rolls between said retracted and raised positions such that said suction rolls engage the underside of successive sheets directed onto said feeder plate from said feed table for raising the engaged sheet and separating it from a following sheet disposed below the engaged sheet.

7. The apparatus of claim 6 in which said suction pressure supply means supplies suction pressure to said suction rolls in predetermined intervals commencing upon said suction rolls being moved to the retracted position for causing said suction rolls to successively engage the underside of each said next following sheet under the action of said suction pressure for a predetermined interval and for transferring said sheet in register toward said front lays.

8. The apparatus of claim 6 in which said suction roll supporting means includes a pair of pivotably mounted levers, and said oscillating means includes means for oscillating said levers.

9. The apparatus of claim 8 in which said oscillating means includes rotatably driven cam means for moving said levers in a predetermined oscillating cycle of movement.

10. The apparatus of claim 9 in which said cam means is adapated for selected eccentric mounting on a cam drive shaft.

11. The apparatus of claim 9 in which said levers are double armed, said suction rolls being mounted between one arm of each said levers, and said cam means being operable for acting on a second arm of at least one of said levers.

12. The apparatus of claim 6 including non-displaceable suction rolls disposed below the flow of said sheets immediately upstream of said oscillating rolls, said non-displaceable suction rolls being rotatably driven, and means for communicating suction pressure to said non-displaceable suction rolls whereby said non-displaceable suction rolls engage the underside of successive sheets under the influence of suction pressure and guide said engaged sheets in proper registration onto said oscillating suction rolls.

13. The apparatus of claim 12 including a deionizer disposed between said oscillating suction rolls and said non-displaceable suction rolls for acting on the flow of sheets passing over said feed plate.

14. The apparatus of claim 13 in which said deionizer is operative for discharging an air flow in timed relation to the flow of said sheets for separating a sheet departing the feed plate from the next following sheet.

15. The apparatus of claim 14 including means for controlling the discharge of air from said deionizer for terminating the air discharge prior to said next following sheet reaching the location of said deionizer.

* * * * *

UNITED STATES PATENT AND TRADEMARK OFFICE

CERTIFICATE OF CORRECTION

PATENT NO. : 4,824,094

DATED : April 25, 1989

INVENTOR(S) : Claus Simeth

It is certified that error appears in the above-identified patent and that said Letters Patent is hereby corrected as shown below:

On the title page, Item [73] should read

-- Assignee: MAN Roland Druckmaschinen AG --.

Signed and Sealed this

Tenth Day of April, 1990

*Attest:*

HARRY F. MANBECK, JR.

*Attesting Officer*

*Commissioner of Patents and Trademarks*